US010061232B2

(12) United States Patent
Shimazu

(10) Patent No.: US 10,061,232 B2
(45) Date of Patent: Aug. 28, 2018

(54) IMAGE FORMING APPARATUS THAT ENSURES REDUCED CALIBRATION PERIOD

(71) Applicant: KYOCERA Document Solutions Inc., Osaka (JP)

(72) Inventor: Kozo Shimazu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/807,362

(22) Filed: Nov. 8, 2017

(65) Prior Publication Data

US 2018/0173137 A1 Jun. 21, 2018

(30) Foreign Application Priority Data

Dec. 21, 2016 (JP) ..... 2016-247404

(51) Int. Cl.
*G03G 15/16* (2006.01)
*G03G 15/01* (2006.01)

(52) U.S. Cl.
CPC ..... *G03G 15/1625* (2013.01); *G03G 15/01* (2013.01); *G03G 15/1665* (2013.01); *G03G 2215/00561* (2013.01); *G03G 2215/00569* (2013.01)

(58) Field of Classification Search
CPC ..... G03G 15/1625; G03G 15/01; G03G 15/1665; G03G 2215/00569; G03G 2215/00561
See application file for complete search history.

(56) References Cited

U.S. PATENT DOCUMENTS

2014/0301748 A1* 10/2014 Suzuki ..... G03G 15/5025 399/49

FOREIGN PATENT DOCUMENTS

JP 2008-292922 A 12/2008

OTHER PUBLICATIONS

IP.com search.*

* cited by examiner

*Primary Examiner* — Lisa M Solomon
(74) *Attorney, Agent, or Firm* — Stein IP, LLC

(57) ABSTRACT

An image forming apparatus includes an image carrier, an endless intermediate transfer belt, a primary transfer member, a secondary transfer member, a displacement amount detecting device, and a control unit. The displacement amount detecting device detects displacement amounts of a reference image in a main-scanning direction and a sub-scanning direction. The reference image is formed on the intermediate transfer belt. The displacement amount detecting device includes a density detecting sensor and a surface potential sensor. The density detecting sensor detects a print density of the reference image formed on the intermediate transfer belt. The surface potential sensor detects a surface potential of the reference image. The displacement amount detecting device simultaneously detects the identical reference image using the density detecting sensor and the surface potential sensor to ensure simultaneous detections of displacement amounts in the main-scanning direction and the sub-scanning direction.

5 Claims, 5 Drawing Sheets

IMAGE FORMING APPARATUS THAT ENSURES REDUCED CALIBRATION PERIOD

INCORPORATION BY REFERENCE

This application is based upon, and claims the benefit of priority from, corresponding Japanese Patent Application No. 2016-247404 filed in the Japan Patent Office on Dec. 21, 2016, the entire contents of which are incorporated herein by reference.

BACKGROUND

Unless otherwise indicated herein, the description in this section is not prior art to the claims in this application and is not admitted to be prior art by inclusion in this section.

In a typical intermediate transfer type color image forming apparatus, a mode for properly setting an image density and registration (hereinafter referred to as a calibration mode) is configurable. Setting the calibration mode transfers a toner image from an image carrier to the intermediate transfer belt to form reference images (patch images) to detect toner amounts of the reference images and displaced amounts from reference positions, so as to correct print densities and color shift correction. For example, in a tandem-type-full-color-image-forming apparatus, respective image forming units of yellow, cyan, magenta, and black form reference images of the respective colors on an intermediate transfer belt, a detecting unit detects print densities and positions of the reference images, and then the print densities and color shifts are corrected.

Now, there is known a technique where two types of reference images of an oblique direction and a horizontal direction are formed, and displaced amounts in a sub-scanning direction and a main-scanning direction are detected in the calibration mode. Specifically, reference images constituted of diagonal lines B1, Y1, C1, and M1 and horizontal lines B2, Y2, C2, and M2 of respective colors of black, yellow, cyan, and magenta, which are illustrated in FIG. 7, are formed. Then, reading positions by a density detecting sensor 45*a* are configured to be the centers of the diagonal lines B1, Y1, C1, and M1 and the horizontal lines B2, Y2, C2, and M2 of the respective colors.

For example, when the displaced amount of the black image is detected, the displaced amount in the sub-scanning direction (a belt circumferential direction) is detected using a period b from a writing reference position w1 to a writing start position w2 of the horizontal line B2. When a formation position of the diagonal line B1 is displaced in the main-scanning direction (a belt width direction), a detecting position of the diagonal line B1 by the density detecting sensor 45*a* also changes. Use of this detects the displaced amount in the main-scanning direction using a difference between a period a from the writing reference position w1 to the detecting position of the diagonal line B1 and the period b. The displaced amounts of the images of yellow, cyan, and magenta are similarly detected, and then writing start positions or writing start timings of the images are adjusted on the basis of detection results.

SUMMARY

An image forming apparatus according to one aspect of the disclosure includes an image carrier, an endless intermediate transfer belt, a primary transfer member, a secondary transfer member, a displacement amount detecting device, and a control unit. A toner image is formed on the image carrier. The endless intermediate transfer belt is located adjacent to the image carrier. The primary transfer member primarily transfers the toner image onto the intermediate transfer belt. The toner image is formed on the image carrier. The secondary transfer member secondarily transfers the toner image onto a recording medium. The toner image is primarily transferred on the intermediate transfer belt. The displacement amount detecting device detects displacement amounts of a reference image in the main-scanning direction and a sub-scanning direction. The reference image is formed on the intermediate transfer belt. The control unit corrects a position displacement of a toner image to be formed on the intermediate transfer belt based on a detection result of the displacement amount detecting device. The displacement amount detecting device includes a density detecting sensor and a surface potential sensor. The density detecting sensor detects a print density of the reference image formed on the intermediate transfer belt. The surface potential sensor detects a surface potential of the reference image. The displacement amount detecting device simultaneously detects the identical reference image using the density detecting sensor and the surface potential sensor to ensure simultaneous detections of displacement amounts in the main-scanning direction and the sub-scanning direction.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
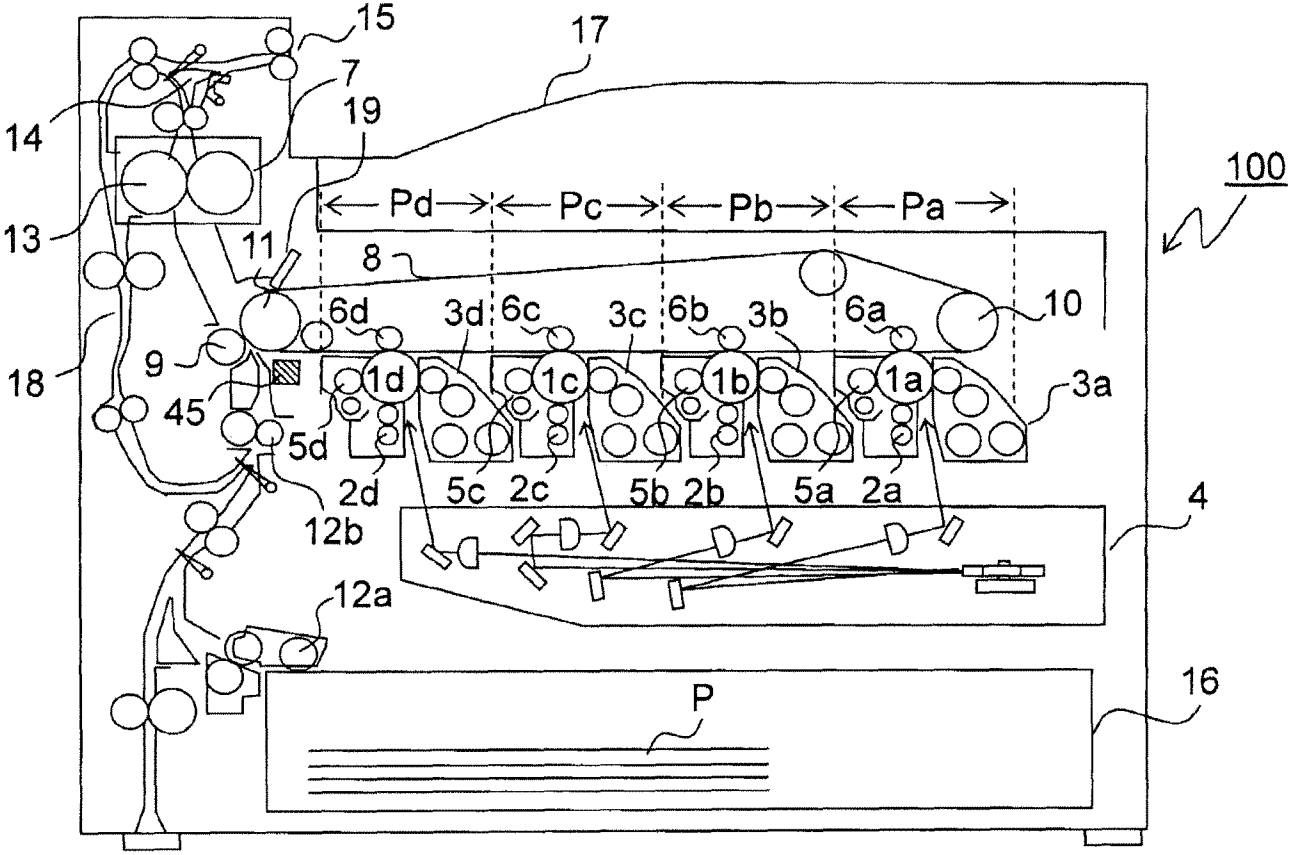
FIG. 1 illustrates a schematic diagram illustrating an overall configuration of a color printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure in detail with reference to the drawings. FIG. 1 illustrates a schematic cross-sectional view of an image forming apparatus (also referred to as a color printer) 100 according to the one embodiment of the disclosure and illustrates a tandem type color printer here. The color printer 100 includes four image forming units Pa, Pb, Pc, and Pd in this order from an upstream side in a running direction of an intermediate transfer belt 8 (a right side in FIG. 1) in its main body. These image forming units Pa to Pd are located corresponding to images of four different colors (cyan, magenta, yellow, and black), and sequentially form the images of cyan, magenta, yellow, and black through respective processes of charging, exposure, development, and transfer.

These image forming units Pa to Pd include photoreceptor drums (also referred to as image carriers) 1*a*, 1*b*, 1*c*, and 1*d*, which carry visible images (toner images) of respective colors, respectively. Additionally, the intermediate transfer belt 8, which rotates in a clockwise direction in FIG. 1, is located adjacent to the respective image forming units Pa to Pd.

When image data is input from a host apparatus such as a personal computer, first, chargers 2*a* to 2*d* evenly charge the surfaces of the photoreceptor drums 1*a* to 1*d*, and then an exposure apparatus 4 irradiates the photoreceptor drums 1*a* to 1*d* with light in accordance with the image data to form electrostatic latent images corresponding to the image data on the respective photoreceptor drums 1*a* to 1*d*. Developing devices 3*a* to 3*d* are filled with predetermined amounts of two-component developers (hereinafter also simply referred to as a developer), which are supplied from toner containers (not illustrated) and include toners of respective colors of cyan, magenta, yellow, and black. The toners in the developers are supplied and electrostatically attached onto the photoreceptor drums 1*a* to 1*d*, on which the electrostatic latent images are formed, by the developing devices 3*a* to 3*d*. This forms the toner images corresponding to the electrostatic latent images formed by the exposure by the exposure apparatus 4.

Then, primary transfer rollers (also referred to as primary transfer members) 6*a* to 6*d* apply electric fields at predetermined transfer voltages between the primary transfer rollers 6*a* to 6*d* and the photoreceptor drums 1*a* to 1*d*, and the toner images of cyan, magenta, yellow, and black on the photoreceptor drums 1*a* to 1*d* are primarily transferred onto the intermediate transfer belt 8. Cleaning apparatuses 5*a* to 5*d* remove a remnant toner or similar matter on the surfaces of the photoreceptor drums 1*a* to 1*d* after the primary transfer.

Transfer papers P, on which toner images are to be transferred, are housed in a paper sheet cassette 16 located in a lower portion in the color printer 100. The transfer paper P is conveyed to a nip portion (secondary transfer nip portion), which is formed between a secondary transfer roller (also referred to as a secondary transfer member) 9 located adjacent to the intermediate transfer belt 8 and the intermediate transfer belt 8, via a feed roller 12*a* and a registration roller pair 12*b* at a predetermined timing. The transfer paper P on which the toner images have been secondarily transferred is conveyed to a fixing unit 7.

The transfer paper P conveyed to the fixing unit 7 is heated and pressured by a fixing roller pair 13. Then the toner image is fixed on a surface of the transfer paper P, thus forming a predetermined full-color image. The transfer paper P, on which the full-color image is formed, is discharged to a discharge tray 17 by a discharge roller pair 15 directly (or after being distributed to an inverting conveyance path 18 by a branching portion 14 and then images are formed on both surfaces).

Figure 2:
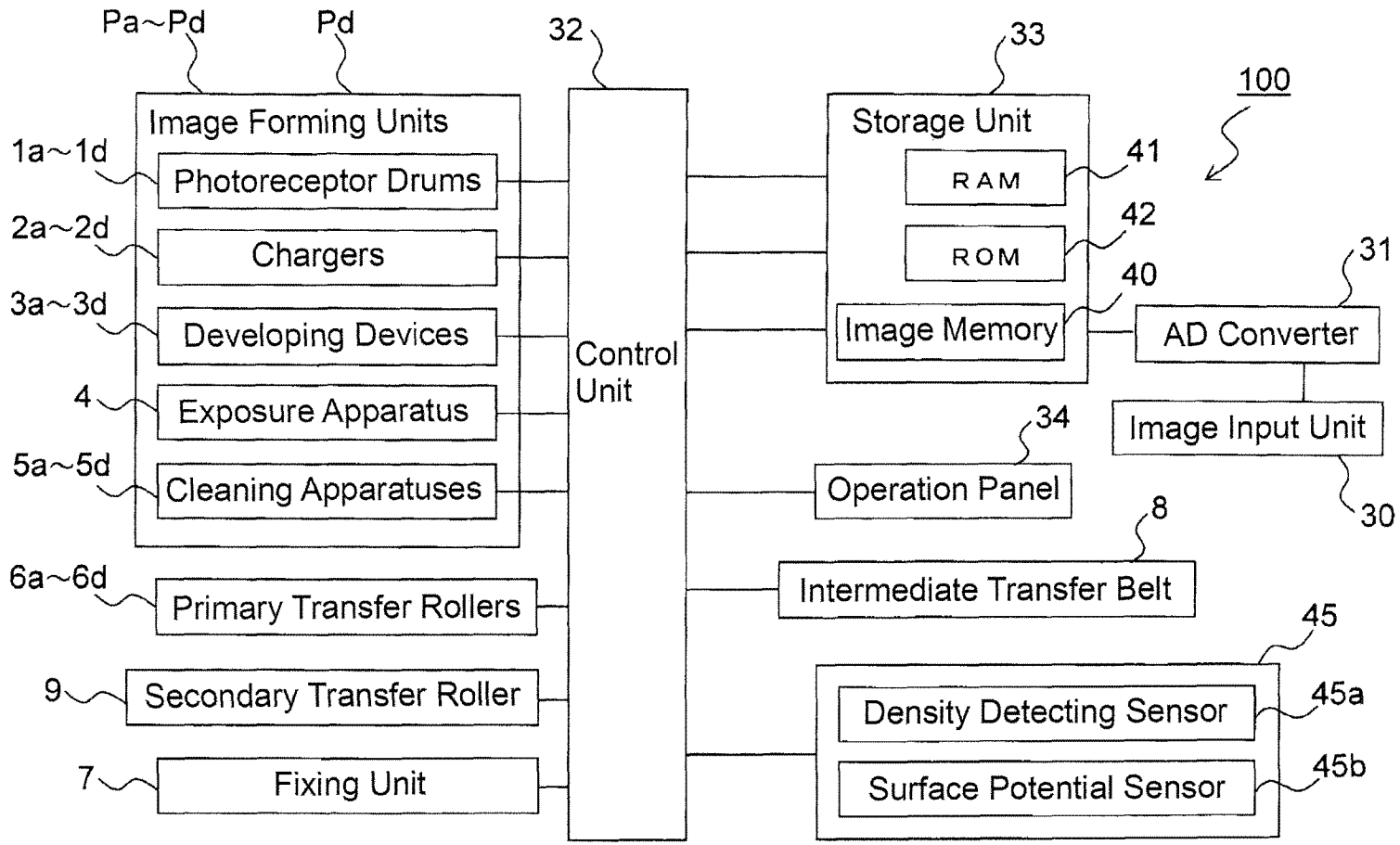
FIG. 2 illustrates a block diagram illustrating a control path of the color printer of the embodiment.

FIG. 2 illustrates a block diagram illustrating a control path of the color printer 100 of the embodiment. Like reference numerals are designated to the configuration similar to those in FIG. 1, and their descriptions are omitted. The color printer 100 includes, for example, the image forming units Pa to Pd, an image input unit 30, an AD converter 31, a control unit 32, a storage unit 33, an operation panel 34, the fixing unit 7, the intermediate transfer belt 8, and an color shift detecting device (also referred to as a displacement amount detecting device) 45.

The image input unit 30 is a receiving unit that receives the image data transmitted from the host apparatus such as the personal computer. The image signal received from the image input unit 30 is delivered to an image memory 40 in the storage unit 33 after being converted into a digital signal by the AD converter 31.

The storage unit 33 includes the image memory 40, a RAM 41, and a ROM 42, and the image memory 40 stores and delivers the image signal, which is received from the image input unit 30 and AD converted by the AD converter 31, to the control unit 32. The RAM 41 and the ROM 42 store processing programs and processing items of the control unit 32.

The RAM 41 (or the ROM 42) stores an color shift correction table in which color shift amounts (described later) of reference images of the respective colors are associated with an exposure start timing or an exposure start position of the exposure apparatus 4.

The operation panel 34 is constituted of: an operation unit constituted of a plurality of operation keys; and a display (none of which is illustrated) that displays, for example, a setting condition and a state of the device, and a user performs setting such as a printing condition.

The control unit 32 is, for example, a central processing unit (CPU) and overall controls, for example, the image input unit 30, the image forming units Pa to Pd, the fixing unit 7, and the conveyance of the transfer paper P from the paper sheet cassette 16 (see FIG. 1) in accordance with a set program and executes a scaling process or a tone process as necessary to convert the image signal received from the image input unit 30 into image data. The exposure apparatus 4 irradiates the photoreceptor drums 1*a* to 1*d* with laser beams on the basis of the image data after the process to form latent images on the photoreceptor drums 1*a* to 1*d*.

Further, the control unit 32 has: a function that receives output signals from a density detecting sensor 45*a* and a surface potential sensor 45*b* and calculates the color shift amount on the basis of the color shift data stored in the storage unit 33 when a key operation from the operation panel 34 and similar operation set a calibration mode; and a function that adjusts an image formation timing on the image forming units Pa to Pd on the basis of the calculated color shift amount to correct color shift. The calibration mode may be automatically set when the color printer 100 is turned on or when an image formation process is performed on a predetermined number of sheets.

The color shift detecting device 45 is constituted of the density detecting sensor 45*a* and the surface potential sensor 45*b*. As illustrated in FIG. 1, the color shift detecting device 45 is located on a downstream with respect to the image forming unit Pd located on the most downstream in the running direction of the intermediate transfer belt 8 and is located on an upstream side with respect to the secondary transfer roller 9.

The color shift detecting device 45 may be located at another position for ensuring the detection of the reference image formed on the intermediate transfer belt 8. However, when, for example, the color shift detecting device 45 is located at the downstream with respect to the secondary transfer roller 9, since a period from the transfer of the reference image onto the intermediate transfer belt 8 until a detection of out of color registration becomes long, and further, since the reference image contacts the secondary transfer roller 9, a surface condition of the reference image may change. Thus, it is preferred that the color shift detecting device 45 be located adjacent to a downstream side of the image forming unit Pd located on the most downstream. The color shift detecting device 45 transmits the output signal corresponding to a detection result to the control unit 32.

Figure 3:
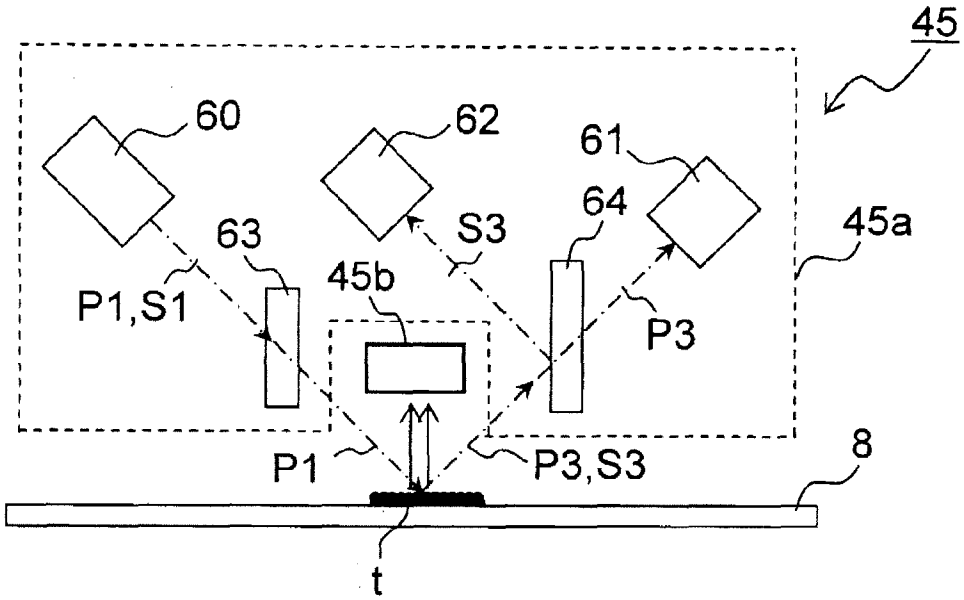
FIG. 3 illustrates an outline diagram illustrating one example of an color shift detecting device employed in the color printer of the embodiment.

FIG. 3 illustrates an outline diagram illustrating one example of the color shift detecting device 45 employed in the color printer 100. As illustrated in FIG. 3, the density detecting sensor 45*a* and the surface potential sensor 45*b*, which constitute the color shift detecting device 45, are located at positions configured to detect an identical position in the reference image.

The density detecting sensor 45*a* includes a light emitting element (for example, an LED) 60, a first light receiving element 61, and a second light receiving element 62. The light emitting element 60 projects a measurement light to a surface of the intermediate transfer belt 8. The first light receiving element 61 and the second light receiving element 62 receive the reflected light reflected from the intermediate transfer belt 8. Between the light emitting element 60 and the intermediate transfer belt 8, a polarizing filter 63 is located and this polarizing filter 63 transmits only a P-polarization light. On the other hand, between the second light receiving element 62 and the intermediate transfer belt 8, a polarization splitting prism 64 is located, and this polarization splitting prism 64 transmits the P-polarization light to provide it to the first light receiving element 61 to reflect an S-polarization light, so as to provide it to the second light receiving element 62. The light emitting element 60 is located at an angle inclined at a predetermined amount with respect to the surface of the intermediate transfer belt 8.

Assume that a toner with a sufficient amount (proper amount) is transferred onto the intermediate transfer belt 8 now. When the measurement light is projected to the intermediate transfer belt 8 from the light emitting element 60, as illustrated in FIG. 3, from the measurement light including a P-polarization light P1 and an S-polarization light S1, the polarizing filter 63 cuts the light S1, and then only the light P1 is projected from the polarizing filter 63 to the intermediate transfer belt 8. The light P1 is transmitted through a toner t without reaching the surface of the intermediate transfer belt 8 and is all reflected by a surface of the toner t.

The polarization splitting prism 64 splits this reflected light into a regular reflected light P3 and a diffusely reflected light S3, the regular reflected light P3 is received by the first light receiving element 61, and the diffusely reflected light S3 is received by the second light receiving element 62. Then, the first and second light receiving elements 61 and 62 photoelectrically convert the lights, which have been received by them, to output first and second output signals. The first and second output signals are transmitted to the control unit 32 (see FIG. 2) after A/D conversion. The control unit 32 calculates a difference between the first and second output signals as a measured output value and then corrects the measured output value on the basis of a reference value (a difference between the first and second output signals when the toner is not attached on the intermediate transfer belt 8) to obtain a corrected output value. That is, assuming that the corrected output value when the toner is not attached is "1," the corrected output value is calculated using a formula (the measured output value/the reference value).

Figure 4:
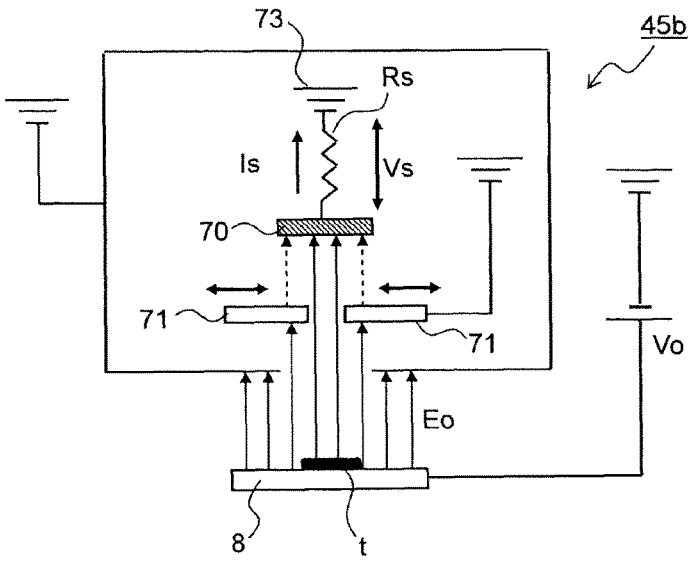
FIG. 4 illustrates an outline diagram illustrating a configuration of a surface potential sensor constituting the color shift detecting device.

FIG. 4 illustrates an outline diagram illustrating one example of a configuration of the surface potential sensor 45*b* constituting the color shift detecting device 45. The surface potential sensor 45*b* uses an electrostatic induction phenomenon to measure a surface potential of a charged object (here, the toner t on the intermediate transfer belt 8) as a measurement target and includes a detection electrode 70, blocking plates 71, and a ground electrode 73. The detection electrode 70 is opposed to the intermediate transfer belt 8. The blocking plates 71 are located between the detection electrode 70 and the intermediate transfer belt 8 and ensure reciprocation. The ground electrode 73 is connected to the detection electrode 70 via a resistor Rs.

The following describes a detection principle of the surface potential sensor 45*b*, when the detection electrode 70 receives an electrostatic field intensity Eo (in proportion to a charge potential Vo) from the toner t, an induced charge q is generated. When the electrostatic field intensity Eo, which reaches the detection electrode 70, are periodically changed by changing an opening width of the blocking plates 71, the induced charge q similarly and periodically changes, and a displacement current Is flows from the detection electrode 70 to the ground electrode 73. This displacement current Is is converted into an alternate current signal Vs by the resistor Rs. The charge potential Vo of the toner t can be detected from this alternate current signal Vs.

Next, the following describes a color shift correction control in the color printer 100 of the embodiment. When the calibration mode is executed and the color shift correction starts, the reference images for correcting out of color registration are formed on the photoreceptor drums 1*a* to 1*d* by the image forming units Pa to Pd and then transferred onto the intermediate transfer belt 8.

Figure 5:
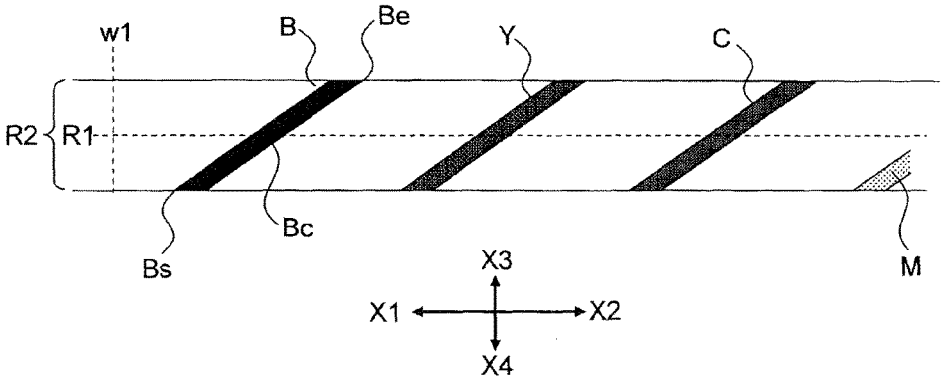
FIG. 5 illustrates a schematic diagram illustrating examples of reference images B, Y, C, and M for color shift correction.

FIG. 5 illustrates examples of reference images B, Y, C, and M for correcting color shifts. The reference images B, Y, C, and M of the respective colors of black, yellow, cyan, and magenta are formed on the intermediate transfer belt 8 at a predetermined interval in the running direction of the intermediate transfer belt 8 (a sub-scanning direction, an arrow X1-X2 direction). The reference images B, Y, C, and M are diagonal lines inclined at a predetermined angle with respect to the main-scanning direction (an arrow X3-X4 direction). A reading position R1 by the density detecting sensor 45*a* is configured to be the centers of the reference images B, Y, C, and M in a width direction of the intermediate transfer belt 8 (the main-scanning direction, the arrow X3-X4 direction). A reading position R2 by the surface potential sensor 45*b* is configured to include all regions of the reference images B, Y, C, and M in the width direction of the intermediate transfer belt 8.

Figure 6A:
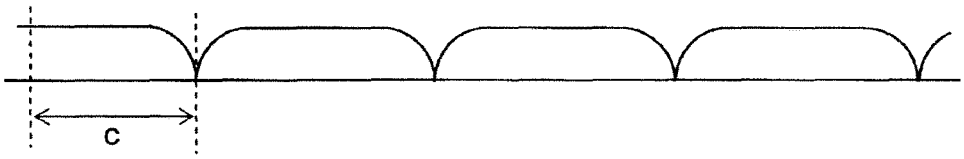
FIGS. 6A and 6B illustrate sensor waveforms when a density detecting sensor and the surface potential sensor detect the reference images B to M illustrated in FIG. 5.
Figure 6B:
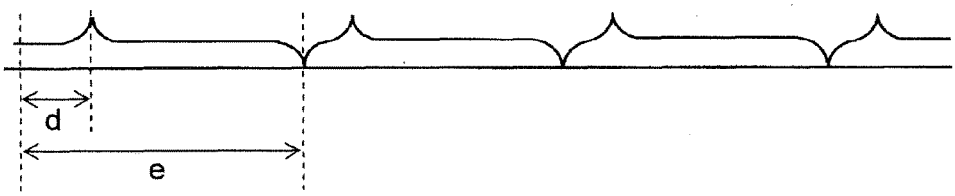
Figure 7:
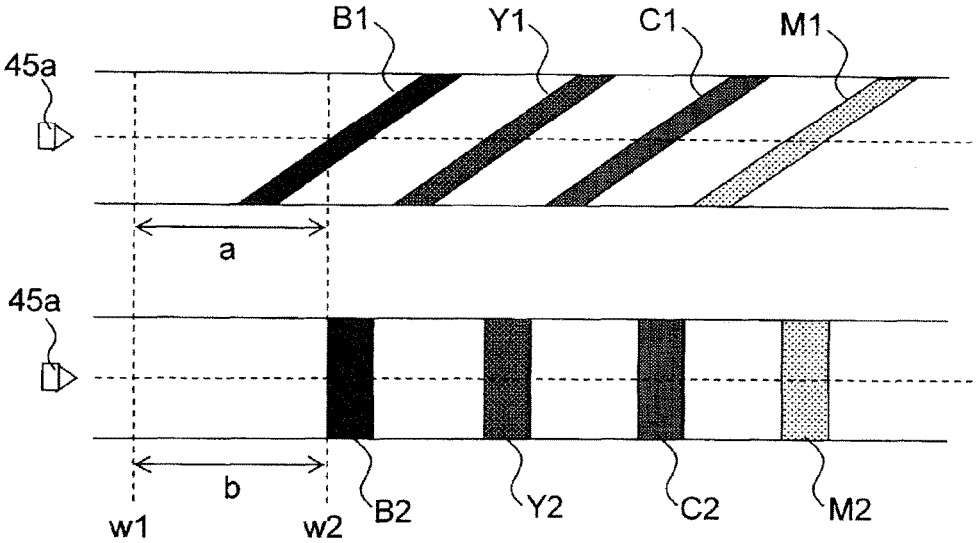
FIG. 7 RELATED ART
FIG. 7 illustrates examples of reference images for color shift correction used in a conventional color image forming apparatus.

FIGS. 6A and 6B illustrate sensor waveforms when the density detecting sensor 45*a* and the surface potential sensor 45*b* detect the reference images B to M illustrated in FIG. 5, respectively. When the density detecting sensor 45*a* reads the reference images B to M, the output value decreases when the reference images B, Y, C, and M has passed the reading position R1. This causes a downward peak to appear as illustrated in FIG. 6A. For example, when the reference image B is read, the output signal has a local minimal value at a timing at which a center portion Bc in a longitudinal direction passes the reading position R1. The same applies to the reference images Y, C, and M.

On the other hand, when the surface potential sensor 45*b* reads the reference images B to M, as a feature of an antenna received signal of the surface potential sensor 45*b*, deviations at writing start positions and writing termination positions of the reference images become large. This is because flowing-out and stability of electric charges occur, and thus electric charge movements (currents) generated at the writing start positions and the writing termination positions are not held when the surface potential sensor 45*b* illustrated in FIG. 4 detects the electric charge movements. Specifically, as illustrated in FIG. 6B, the received signal has a local maximal value when an end edge Bs on a writing start side of the reference image B passes the reading position R2. The received signal has a local minimal value when an end edge Be on a writing termination side passes the reading position R2. The same applies to the reference image Y, C, and M.

The control unit 32 uses the sensor waveforms illustrated in FIGS. 6A and 6B to calculate color shift amounts in the sub-scanning direction and the main-scanning direction, so as to adjust the exposure start position or the exposure start timing of the exposure apparatus 4 on the basis of the calculated color shift amounts. The color shift amount in the sub-scanning direction is calculated from time differences between: periods from a writing reference position w1 (a time point of writing reference) to the local maximal value and the local minimal value of the received signal of the surface potential sensor 45*b*; and target values of the respective periods.

For example, when color shift of a black image in the sub-scanning direction is corrected, the exposure start position or the exposure start timing of the exposure apparatus 4 is adjusted such that a period d from the writing reference position w1 (the time point of writing reference) until the end edge Bs on the writing start side is detected and a period e from the writing reference position w1 until the end edge Be on the writing termination side is detected match target values.

The color shift amount in the main-scanning direction is calculated from a difference between: a period from the writing reference position w1 (the time point of writing reference) to the local minimal value of the output signal of the density detecting sensor 45*a*; and a period from the writing reference position w1 to the center position between the local maximal value and the local minimal value of the received signal of the surface potential sensor 45*b*.

For example, when correcting the color shift of the black image in the main-scanning direction, the exposure start position or the exposure start timing of the exposure apparatus 4 is adjusted such that a period to a center portion Bc of the reference image B detected by the density detecting sensor 45*a* matches a period to the center between the end edge Bs on the writing start side and the end edge Be on the writing termination side, which are detected by the surface potential sensor 45*b*. Specifically, it is only necessary that the period c from the writing reference position w1 (the time point of writing reference) until the local minimal value of the output signal of the density detecting sensor 45*a* is detected, and the periods d and e from the writing reference position w1 until the local maximal value and the local minimal value of the surface potential sensor 45*b* are detected satisfy the following formula (1).

$$c=d+\{(e-d)/2\} \qquad \text{Formula (1)}$$

Correcting the color shifts of the respective colors in the above-described procedure ensures correcting the color shifts of both the main-scanning direction and the sub-scanning direction using only one type (one set) of the formed reference images B to M illustrated in FIG. 5. This ensures the correcting color shifts using the number of reference images less than those of the conventional cases, which reduces the formation period of reference images, the reading period, and the cleaning period, thus ensuring the reduced calibration period. Additionally, the toner amounts required for the formation of the reference images also decreases, which reduces waste consumption of toners used for purposes other than printing, ensuring the reduced running cost of the color printer 100.

A print density correction may be executed before the above-described color shift correction is executed, or after the execution. When executing the print density correction, reference images (not illustrated) having a plurality of phases of print densities for correcting the print density are formed on an upstream side or a downstream side of the reference images B to M in the running direction of the intermediate transfer belt 8, and then the density detecting sensor 45*a* detects print densities of the respective reference images.

While a method for adjusting an image density includes a method for adjusting: charge potentials of the photoreceptor drums 1*a* to 1*d*; developing-bias potentials of the developing devices 3*a* to 3*d*; or an exposure amount of the exposure apparatus 4 on the basis of the print density of the reference image for correcting print density detected by the density detecting sensor 45*a* and similar method, a common adjustment method is a method for adjusting a characteristic value of a developing bias. For example, when a developing bias where an AC bias is superimposed on a DC bias is used, any one of a DC component voltage (Vdc), a peak-to-peak value (Vpp) of an AC component, a proportion (Duty ratio) of a period of a positive-side waveform to one cycle of an AC waveform, and a frequency (f) are changed.

The disclosure is not limited to the above-described embodiment and can be variously modified without departing from the spirit of the disclosure. For example, the patterns of the reference images B to M described in the above-described embodiment are examples, and another pattern may be used.

The disclosure is not limited to the color printer 100 illustrated in FIG. 1, and is applicable to various kinds of intermediate-transfer-type image forming apparatuses, such as a color copier, a digital multi-functional peripheral, and a facsimile. For example, it is similarly applicable to an intermediate transfer type monochrome printer where one photoreceptor drum on which a black image is formed and one primary transfer roller opposed to the photoreceptor drum are located across an intermediate transfer belt. Since a monochrome printer does not cause out of color registration, the disclosure is applicable to a correction of an image formation position on a paper sheet.

The disclosure is applicable to an intermediate transfer type image forming apparatus where an intermediate transfer belt is employed. Use of the disclosure ensures a provision of an image forming apparatus that corrects a position displacement of a toner image to be primarily transferred onto the intermediate transfer belt with high accuracy and in a short time.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an image carrier on which a toner image is formed;

an endless intermediate transfer belt located adjacent to the image carrier;

a primary transfer member that primarily transfers the toner image onto the intermediate transfer belt, the toner image being formed on the image carrier;

a secondary transfer member that secondarily transfers the toner image onto a recording medium, the toner image being primarily transferred on the intermediate transfer belt;

a displacement amount detecting device that detects displacement amounts of a reference image in a main-scanning direction and a sub-scanning direction, the reference image being formed on the intermediate transfer belt; and a control unit that corrects a position displacement of a toner image to be formed on the intermediate transfer belt based on a detection result of the displacement amount detecting device, wherein the displacement amount detecting device includes:

a density detecting sensor that detects a print density of the reference image formed on the intermediate transfer belt; and a surface potential sensor that detects a surface potential of the reference image, and the displacement amount detecting device simultaneously detects the identical reference image using the density detecting sensor and the surface potential sensor to ensure simultaneous detections of displacement amounts in the main-scanning direction and the sub-scanning direction.

2. The image forming apparatus according to claim 1, wherein the reference image includes a diagonal line inclined at a predetermined angle with respect to the main-scanning direction, and the displacement amount detecting device detects a displacement amount in the main-scanning direction based on a time difference between a detection timing at which a center position between a writing start position and a writing termination position of the reference image are detected by the surface potential sensor and a timing at which a center portion of the reference image is detected by the density detecting sensor.

3. The image forming apparatus according to claim 2, wherein the control unit corrects a position displacement in the main-scanning direction such that the following formula (1) is satisfied, $$c=d+\{(e-d)/2\} \quad (1),$$

wherein c: a period from a time point of writing reference until a local minimal value of an output signal of the density detecting sensor is detected, d: a period from the time point of writing reference until a local maximal value of an output signal of the surface potential sensor is detected, and e: a period from the time point of writing reference until a local minimal value of an output signal of the surface potential sensor is detected.

4. The image forming apparatus according to claim 2, wherein the displacement amount detecting device detects a displacement amount in the sub-scanning direction based on detection timings at which the writing start position and the writing termination position of the reference image are detected by the surface potential sensor.

5. The image forming apparatus according to claim 1 further comprising:

a plurality of the image carriers; and a plurality of the primary transfer members opposed to the respective image carriers across the intermediate transfer belt, wherein the displacement amount detecting device is an out-of-color-registration detecting device that detects color shift amounts between images to be primarily transferred onto the intermediate transfer belt from the plurality of image carriers.

* * * * *